US006851263B2

(12) United States Patent
Stumpf et al.

(10) Patent No.: US 6,851,263 B2
(45) Date of Patent: Feb. 8, 2005

(54) LINER FOR A GAS TURBINE ENGINE COMBUSTOR HAVING TRAPPED VORTEX CAVITY

(75) Inventors: James Anthony Stumpf, Milford, OH (US); Beverly Stephenson Duncan, West Chester, OH (US); David Louis Burrus, Cincinnati, OH (US); Clayton Stuart Cooper, Loveland, OH (US)

(73) Assignee: General Electric Company, Schenectady, NY (US)

( * ) Notice: Subject to any disclaimer, the term of this patent is extended or adjusted under 35 U.S.C. 154(b) by 216 days.

(21) Appl. No.: 10/282,520

(22) Filed: Oct. 29, 2002

(65) Prior Publication Data

US 2004/0079083 A1 Apr. 29, 2004

(51) Int. Cl.[7] ..... F02C 1/00
(52) U.S. Cl. ..... 60/750; 60/752; 60/755
(58) Field of Search ..... 60/750, 752, 755, 60/758, 760, 804

(56) References Cited

U.S. PATENT DOCUMENTS 5,323,602 A * 6/1994 Defever ..... 60/804
5,619,855 A 4/1997 Burrus ..... 60/736
5,791,248 A 8/1998 Atkins et al. ..... 60/752
5,857,339 A 1/1999 Roquemore et al. ..... 60/749
6,286,298 B1 9/2001 Burrus et al. ..... 60/39.06
6,286,317 B1 9/2001 Burrus et al. ..... 60/752
6,295,801 B1 10/2001 Burrus et al. ..... 60/39.06
6,334,298 B1 * 1/2002 Aicholtz ..... 60/796
6,401,447 B1 6/2002 Rice et al. ..... 60/39.31

* cited by examiner

*Primary Examiner*—Charles G. Freay
(74) *Attorney, Agent, or Firm*—William Scott Andes; James P. Davidson

(57) ABSTRACT

A liner for a gas turbine engine combustor having a trapped vortex cavity formed therein, wherein a dome plate is positioned at an upstream end of the combustor, includes: a first portion positioned adjacent and connected to the dome plate, wherein the first liner portion extends downstream from and substantially perpendicular to the dome plate; a second portion extending substantially perpendicular to the first liner portion and substantially parallel to the dome plate; a first arcuate portion having a predetermined radius located between the first and second liner portions; a third portion extending downstream and substantially perpendicular to the second liner portion; and, a second arcuate portion located between the second and third liner portions; wherein the first liner portion, the second liner portion, the first arcuate liner portion and a portion of the dome plate form the trapped vortex cavity.

20 Claims, 4 Drawing Sheets

LINER FOR A GAS TURBINE ENGINE COMBUSTOR HAVING TRAPPED VORTEX CAVITY

The Government has rights to this invention pursuant to Contract No. F33615-97-C-2778 awarded by the United States Air Force.

BACKGROUND OF THE INVENTION

The present invention relates to a gas turbine engine combustor having at least one trapped vortex cavity and, more particularly, to a liner for such combustor forming at least a portion of such trapped vortex cavity which is arcuate in a transition area between adjacent portions so as to relieve stress and possible deflection.

Advanced aircraft gas turbine engine technology requirements are driving the combustors therein to be shorter in length, have higher performance levels over wider operating ranges, and produce lower exhaust pollutant emission levels. One example of a combustor designed to achieve these objectives employs a trapped vortex cavity, as disclosed in U.S. Pat. Nos. 5,619,855 and 5,791,148 to Burrus. As seen therein, the Burrus combustor has inner and outer liners attached to the dome inlet module which include upstream cavity portions for creating a trapped vortex of fuel and air therein, as well as downstream portions extending to the turbine nozzle.

Further refinements to the combustor disclosed in the aforementioned patents are disclosed in U.S. Pat. Nos. 6,286,298 and 6,295,801 to Burrus et al., where a dome inlet module separate from the diffuser is described. It will be seen therefrom that a fuel injector bar is utilized to supply fuel to the openings between the vanes of the dome inlet module. In this way, a Rich-Quench-Lean (RQL) process is employed to achieve low emissions in the combustor. Additional improvements to the trapped vortex cavity (TVC) combustor have also been disclosed to increase cooling of the liners at indicated locations (U.S. Pat. No. 6,286,317 to Burrus et al.) and to alleviate interference between dome-to-liner joints and the fuel injectors (U.S. Pat. No. 6,334,298 to Aicholtz).

It has now been found that stress at a corner of the liners adjacent the rear walls is unsatisfactory and could lead to potential deflection or collapse of the rear liner wall. Further, flow characteristics in the cavity indicate that recirculation zones are formed in the same liner corners which create undesirable heat stress. In light of high temperature capability of such material, it is also contemplated that Ceramic Matrix Composite (CMC) be utilized for the liners of the TVC combustor. This has led to other concerns for the same corner location, as such material is currently limited in its processing for geometries involving minimal corner fillets.

Accordingly, it would be desirable for a liner to be developed for a trapped vortex cavity combustor which does not incur stress above an acceptable level. It is also desirable for the flow characteristics and cooling in a corner thereof be improved. Further, it would be desirable if such liner could be configured so as to enable use of Ceramic Matrix Composite therefor.

BRIEF SUMMARY OF THE INVENTION

In accordance with one aspect of the present invention, a liner for a gas turbine engine combustor having a trapped vortex cavity formed therein is disclosed, wherein a dome plate is positioned at an upstream end of the combustor. The liner includes a first portion positioned adjacent and connected to the dome plate, wherein the first liner portion extends downstream from and substantially perpendicular to the dome plate, a second portion extending substantially perpendicular to the first liner portion and substantially parallel to the dome plate, a first arcuate portion having a predetermined radius located between the first and second liner portions, a third portion extending downstream and substantially perpendicular to the second liner portion, and a second arcuate portion located between the second and third liner portions. Accordingly, the first liner portion, the second liner portion, the first arcuate liner portion and a portion of the dome plate form the trapped vortex cavity.

In accordance with a second aspect of the present invention, a gas turbine engine combustor having at least one trapped vortex cavity located adjacent a combustion chamber thereof is disclosed. The combustor includes an annular dome plate positioned at an upstream end of the combustion chamber, the dome plate having a plurality of circumferentially spaced inlet passages formed therein, a device positioned between adjacent flow passages of the dome plate for injecting fuel in the inlet passages and the trapped vortex cavity, an outer liner connected at an upstream end to the dome plate, and an inner liner connected at an upstream end to the dome plate. At least one of the outer and inner liners further includes a first portion extending downstream from and substantially perpendicular to the dome plate, a second portion extending substantially perpendicular to the first liner portion and substantially parallel to the dome plate, a first arcuate portion having a predetermined radius located between the first and second liner portions, a third portion extending downstream and substantially perpendicular to the second liner portion, and a second arcuate portion located between the second and third liner portions. Accordingly, the first liner portion, the second liner portion, the first arcuate liner portion and a portion of the dome plate form the trapped vortex cavity.

BRIEF DESCRIPTION OF THE DRAWINGS

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
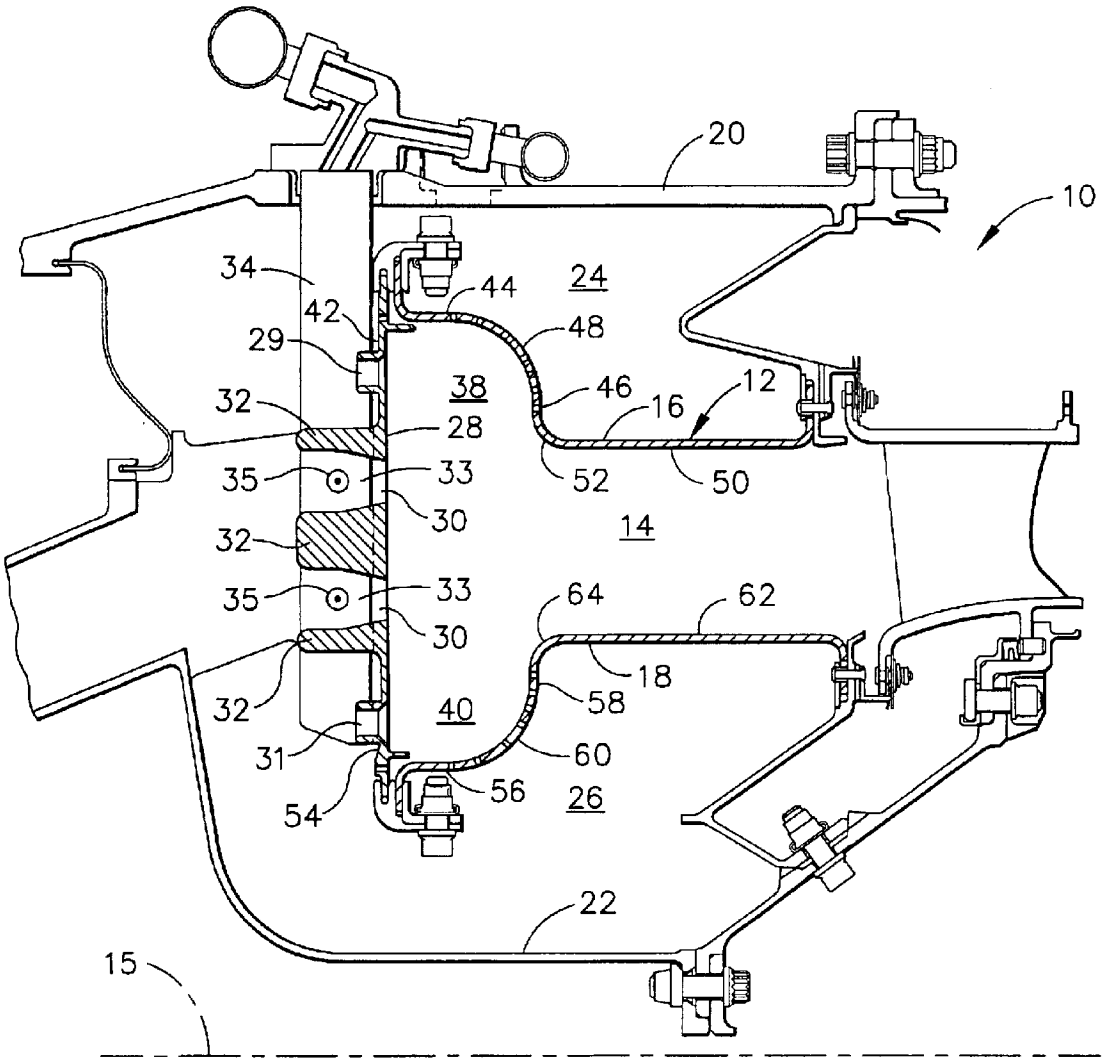
FIG. 1 is a longitudinal cross-sectional view of a gas turbine engine combustor having a trapped vortex cavity with a metal liner in accordance with the present invention.

Referring now to the drawings in detail, wherein identical numerals indicate the same elements throughout the figures, FIG. 1 depicts a combustor 10 for use in a gas turbine engine which includes a hollow body 12 defining a combustion chamber 14 therein. Hollow body 12 is generally annular in form about a centerline axis 15 and includes an outer liner 16 and an inner liner 18 disposed between an outer combustor casing 20 and an inner combustor casing 22, respectively. Outer liner 16 and outer combustor casing 20 form an outer radial passage 24 therebetween, whereas inner liner 18 and inner combustor casing 22 form an inner passage 26 therebetween.

Figure 2:
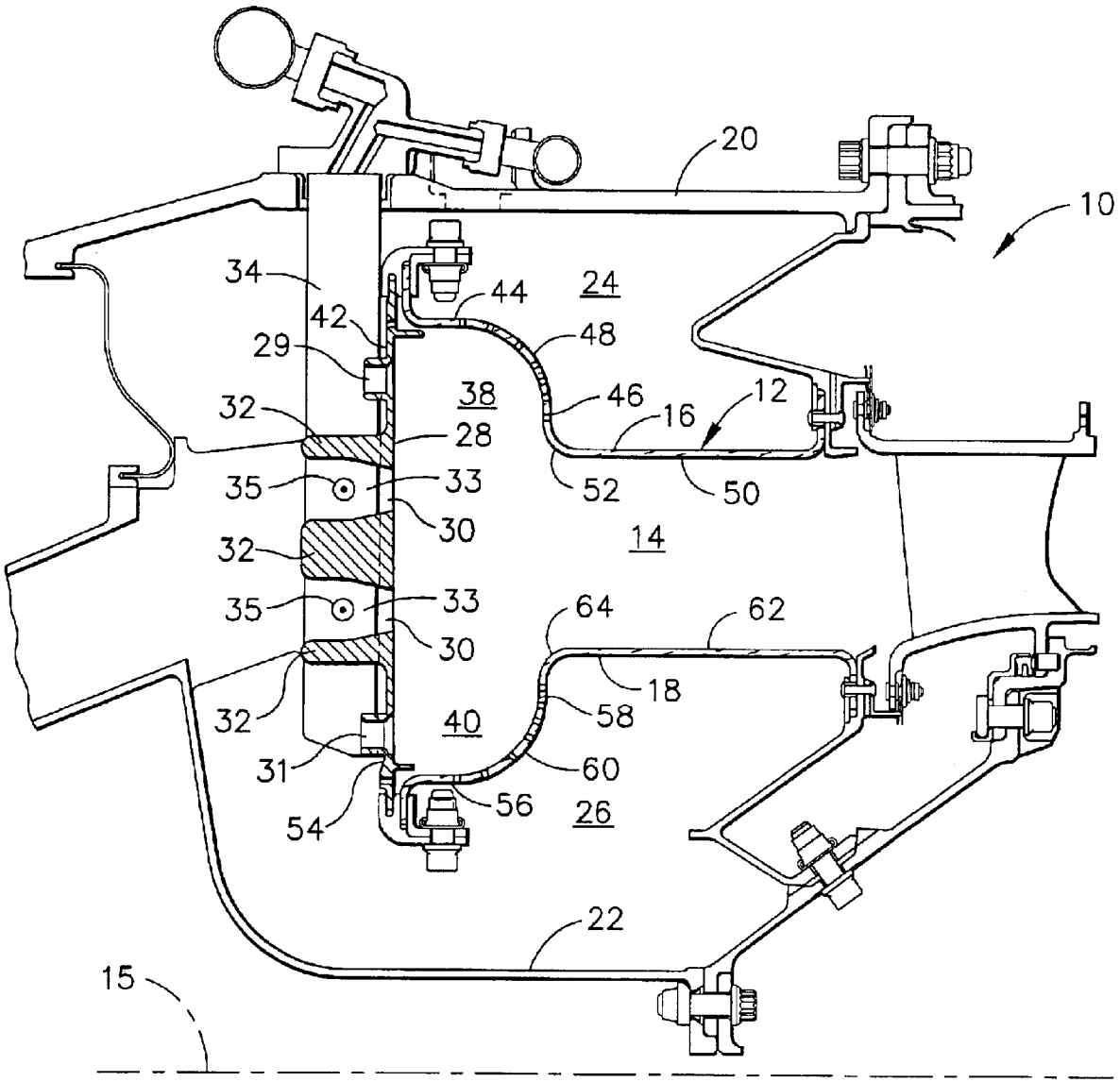
FIG. 2 is a longitudinal cross-sectional view of a gas turbine engine combustor having a trapped vortex cavity with a liner made of Ceramix Matrix Composite in accordance with the present invention.

It will be appreciated that a dome plate 28 is preferably like that disclosed in U.S. Pat. No. 6,334,298 to Aicholtz, although it may be like that shown and disclosed in U.S. Pat. No. 5,619,855 to Burrus or U.S. Pat. No. 6,295,801 to Burrus et al., each of which is owned by the assignee of the current invention and is hereby incorporated by reference. Accordingly, a generally flat, annular dome plate 28 is positioned at an upstream end of hollow body 12 and preferably lies in a plane that is substantially perpendicular to the core flow streamline through combustor 10. At least one, and preferably a plurality, of openings 30 are formed in a middle portion of dome plate 28 so that fuel and compressed air are permitted to flow into combustion chamber 14. It will be appreciated that dome plate 28 preferably includes a pair of baffles 32 extending upstream and positioned adjacent each opening 30 to form an inlet passage 33 in alignment with each opening 30 to assist in directing air into combustion chamber 14. Moreover, a plurality of fuel injector bars 34 are able to provide fuel within each inlet passage 33 via an atomizer 35, where each fuel injector bar 34 is located within one of a plurality of circumferentially spaced slots or openings formed within baffles 32. Dome plate 28 is preferably connected to outer and inner liners 16 and 18 in a manner described in the '298 patent when outer and inner liners 16 and 18 are made of a metal or other superalloy (see FIG. 1). Certain modifications to such connection may be made when outer and inner liners 16 and 18 are made of a Ceramic Matrix Composite (CMC), as shown in FIG. 2, to accommodate differences in radial and axial growth between dome plate 28 and liners 16 and 18.

In order to achieve and sustain combustion, combustor 10 includes at least one trapped vortex cavity formed therein. As seen in FIG. 1, a first trapped vortex cavity 38 is preferably formed at a radially outer portion of combustor 10 and a second trapped vortex cavity 40 is preferably formed at a radially inner portion of combustor 10. It will be noted that a pair of supplementary openings 29 and 31 are preferably located in outer and inner radial portions 42 and 54 of dome plate 28 to provide fuel and air into first and second trapped vortex cavities 38 and 40. First trapped vortex cavity 38 is formed at an upstream end by an outer radial portion 42 of dome plate 28, a first portion 44 of outer liner 16 positioned adjacent and connected to dome plate 28, wherein first outer liner portion 44 extends downstream from and substantially perpendicular to dome plate 28, and a second portion 46 of outer liner 16 extending substantially perpendicular to first outer liner portion 44 and substantially parallel to dome plate 28. In order to alleviate structural and heat stress on outer liner 16, a first arcuate portion 48 of outer liner 16 is provided between first and second outer liner portions 44 and 46. It will also be noted that outer liner 16 preferably includes a third portion 50 extending downstream from and substantially perpendicular to second outer liner portion 46, as well as a second arcuate portion 52 located between second and third outer liner portions 46 and 50.

Similarly, second trapped vortex cavity 40 is formed at an upstream end by an inner radial portion 54 of dome plate 28, a first portion 56 of inner liner. 18 positioned adjacent and connected to dome plate 28, wherein first inner liner portion 56 extends downstream from and substantially perpendicular to dome plate 28, and a second portion 58 of inner liner 18 extending substantially perpendicular to first inner liner portion 56 and substantially parallel to dome plate 28. Once again, a first arcuate portion 60 of inner liner 18 is preferably provided between first and second inner liner portions 56 and 58. Inner liner preferably includes a third portion 62 extending downstream from and substantially perpendicular to second inner liner portion 58, as well as a second arcuate portion 64 located between second and third inner liner portions 58 and 62.

With respect to first arcuate portions 48 and 60 of outer and inner liners 16 and 18, respectively, it will be appreciated that a minimum radius R therefor is desired in order to reduce the stress on second outer liner portion 46 and second inner liner portion 58 to an acceptable level (i.e., preferably not more than approximately 20,000 pounds per square inch when CMC is utilized therefor). Alternatively, it will be understood that the configuration of outer and inner liners 16 and 18 is such that the axial deflection of third outer liner portion 50 and third inner liner portion 62 is minimized.

More specifically, it has been found that radius RI of first arcuate portions 48 and 60 preferably is in a range at least approximately 3–5 times a thickness t for first and second portions 44 and 46 of outer liner 16 and first and second portions 56 and 58 of inner liner 18, more preferably in a range of approximately 6–12 times thickness t, and optimally in a range of approximately 7–9 times thickness t. At the same time, radius $R_1$ of first arcuate portions 48 and 60 preferably is no greater than a length l of first liner portions 44 and 56 and preferably is no greater than a height h of second liner portions 58 and 60. Accordingly, it will be understood that a centerpoint $c_1$ for radius $R_1$ will be located along a radial plane positioned between a radial plane through dome plate 28 and a radial plane 66 through first liner portions 44 and 56, where radial plane 66 is positioned at a point approximately in the middle of first liner portions 44 and 56.

Figure 3:
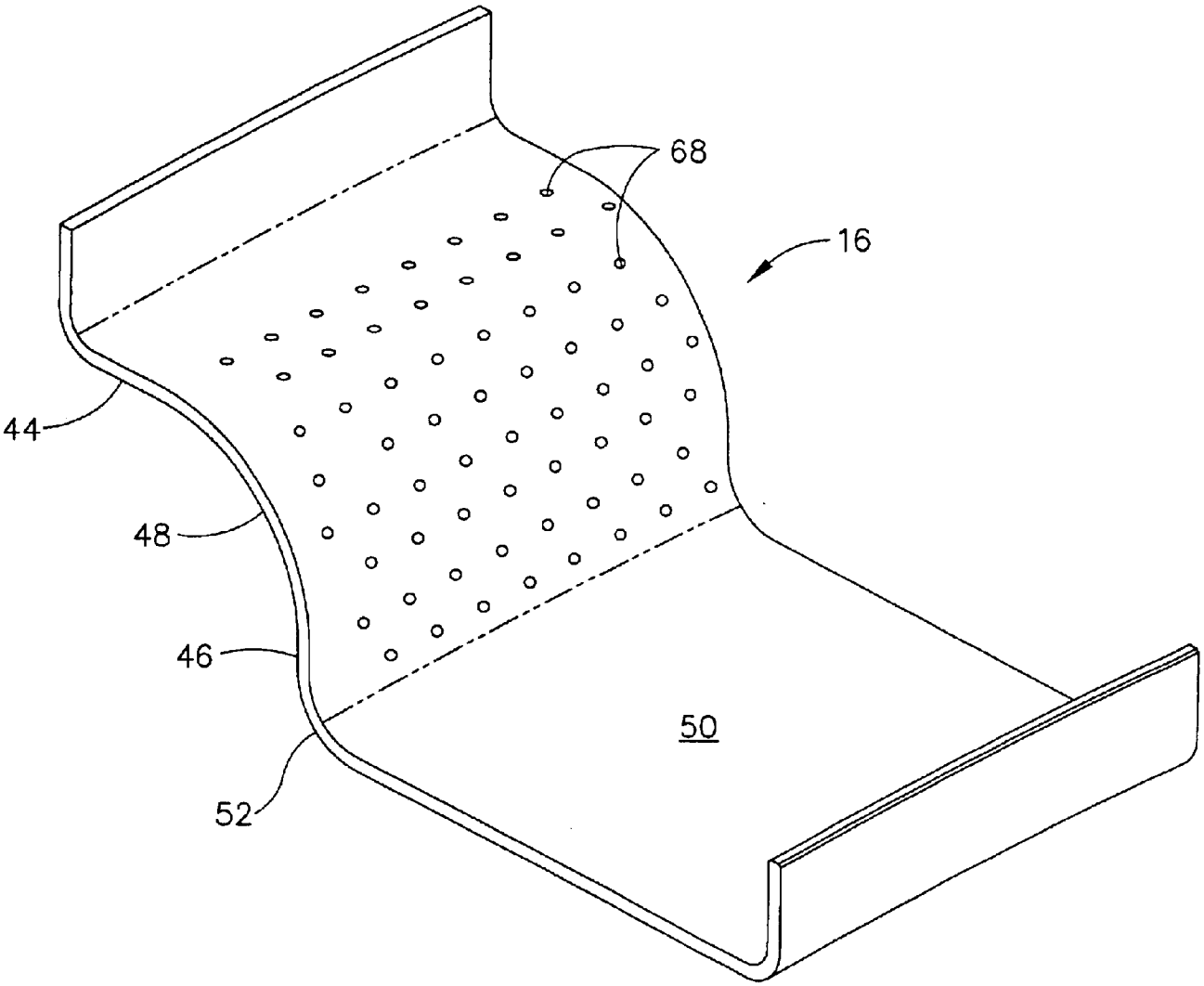
FIG. 3 is a rear perspective view of the combustor outer liner depicted in FIG. 2; and, FIG. 4 is an enlarged, partial cross-sectional view of the combustor depicted in FIG. 2.

As best seen in FIG. 3 with respect to outer liner 16, first arcuate liner portion 48 preferably includes a predetermined pattern of cooling holes 68 formed therein so as to alleviate the thermal stress at such location. It will be seen that cooling holes 69 are arranged in a series of rows having a preferred spacing of approximately 5–7 times the diameter between such cooling holes 69. Further, each row of cooling holes 69 is preferably staggered with respect to the adjacent cooling hole row.

Figure 4:
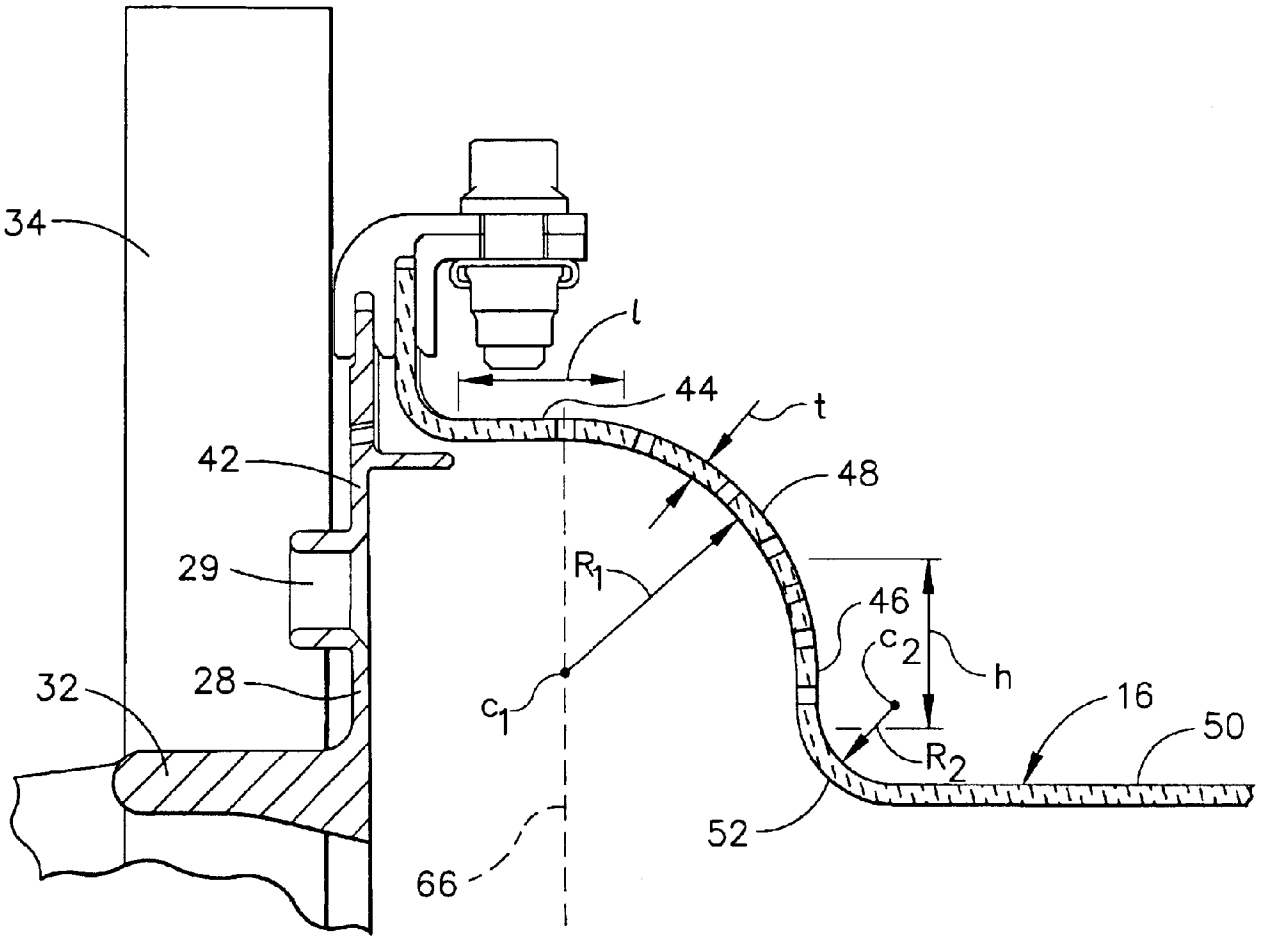

Second arcuate portions 52 and 64 of outer and inner liners 16 and 18 similarly arc preferred to have a predetermined radius $R_2$ with a centerpoint $c_2$ so as to reduce the stress on second outer liner portion 46 and second inner liner portion 58 (see FIG. 4). It has been found that radius $R_2$ of second arcuate portions 52 and 64 preferably is in a range of approximately 1–7 times thickness t of first and second portions 44 and 46 of outer liner 16 and first and second portions 56 and 58 of inner liner 18 and more preferably in a range of approximately 3–5 times thickness t.

It will be appreciated that outer and inner liners 16 and 18 are typically made of a metal or superalloy material such as nickel-based superalloys. In an effort to utilize materials having an even higher heat temperature capability than conventional metals, outer and inner liners 16 and 18 preferably are made of a Ceramic Matrix Composite (CMC) as shown in FIG. 2. Examples of such CMC material include silicon carbide, silica or alumina matrix materials and combinations thereof. Because CMC is generally woven, it has further been found that processing such material so as to contain an arcuate section with an extremely small radius is difficult at best. Thus, radius R of first arcuate portions 48 and 60 is also limited by the capability of producing liners having the configuration described herein but still falls within the parameters described above. Further, when outer and inner liners 16 and 18 are made of CMC, it will be understood that connection of such liners 16 and 18 to dome plate 28 will preferably be performed in a manner which accommodates differences in thermal growth due to the use of a different material for dome plate 28.

In operation, combustor 10 utilizes the combustion regions within first and second trapped vortex cavities 38 and 40 as the pilot, with fuel and air only being provided through secondary openings 29 and 31 to create a trapped vortex of fuel and air therein. Thereafter, the mixture of fuel and air within cavities 38 and 40 are ignited, such as by an igniter (not shown), to form combustion gases therein. These combustion gases then exhaust from cavities 38 and 40 across a downstream end of dome plate 28 so as to interact with the core flow streamline entering through inlet passages 33. It will be understood that if higher power or additional thrust is required, fuel is injected into inlet passages 33 by fuel injector bars 34, such fuel being mixed with the main stream air flowing therethrough. The mixture of fuel and main stream air is preferably ignited by the cavity combustion gases exhausting across the downstream end of dome plate 28. Thus, combustor 10 operates in a dual stage manner depending on the requirements of the engine.

Having shown and described the preferred embodiment of the present invention, further adaptations of the liners for forming a trapped vortex cavity can be accomplished by appropriate modifications by one of ordinary skill in the art without departing from the scope of the invention.

What is claimed is:

1. A liner for a gas turbine engine combustor having a trapped vortex cavity formed therein, wherein a dome plate is positioned at an upstream end of said combustor, said liner comprising:

(a) a first portion positioned adjacent and connected to said dome plate, wherein said first liner portion extends downstream from and substantially perpendicular to said dome plate;

(b) a second portion extending substantially perpendicular to said first liner portion and substantially parallel to said dome plate;

(c) a first arcuate portion having a predetermined radius located between said first and second liner portions, wherein said predetermined radius of said first arcuate liner portion is at least approximately 3–5 times a thickness for said first and second liner portions;

(d) a third portion extending downstream and substantially perpendicular to said second liner portion; and, (e) a second arcuate portion located between said second and third liner portions;

wherein said first liner portion, said second liner portion, said first arcuate liner portion and a portion of said dome plate form said trapped vortex cavity.

2. The liner of claim 1, wherein said liner is made of metal.

3. The liner of claim 1, wherein said liner is made of Ceramic Matrix Composite material.

4. The liner of claim 1, wherein said liner is an outer liner of said combustor.

5. The liner of claim 1, wherein said liner is an inner liner of said combustor.

6. The liner of claim 1, wherein said predetermined radius of said first arcuate liner portion is no greater than a length of said first line portion.

7. The liner of claim 1, wherein said predetermined radius of said first arcuate liner portion is no greater than a height of said second liner portion.

8. The liner of claim 1, wherein a centerpoint for said predetermined radius of said first arcuate liner portion is located along a radial plane positioned between said dome plate and a radial plane through said first liner portion.

9. The liner of claim 1, wherein a centerpoint for said predetermined radius of said first arcuate liner portion is located along a radial plane positioned between said dome plate and approximately one-half a length of said first liner portion.

10. The liner of claim 1, wherein said first arcuate liner portion includes a multihole cooling pattern formed therein.

11. The liner of claim 1, wherein said second arcuate liner portion has a predetermined radius in a range of approximately 3–5 times said thickness for said first and second liner portions.

12. The liner of claim 1, wherein said predetermined radius of said first arcuate portion is in a range of approximately 6–12 times said thickness for said first and second liner portions.

13. A gas turbine engine combustor having at least one trapped vortex cavity located adjacent a combustion chamber thereof, comprising:

(a) an annular dome plate positioned at an upstream end of said combustion chamber, said dome plate having a plurality of circumferentially spaced flow passages formed therein;

(b) a device positioned between adjacent flow passages of said dome plate for injecting fuel in said flow passages and said trapped vortex cavity;

(c) an outer liner connected at an upstream end to said dome plate; and (d) an inner liner connected at an upstream end to said dome plate, at least one of said outer and inner liners further comprising:

(1) a first portion extending downstream from and substantially perpendicular to said dome plate;

(2) a second portion extending substantially perpendicular to said first liner portion and substantially parallel to said dome plate;

(3) a first arcuate portion having a predetermined radius located between said first and second liner portions, wherein said predetermined radius of said first arcuate liner portion is at least approximately 3–5 times a thickness for said first and second liner potions;

(4) a third portion extending downstream and substantially perpendicular to said second liner portion; and, (5) a second arcuate portion located between said second and third liner portions;

wherein said first liner portion, said second liner portion, said first arcuate liner portion and a portion of said dome plate form said trapped vortex cavity.

14. The combustor of claim 13, said trapped vortex cavity being formed by a first portion of said outer liner, a second portion of said outer liner, a first arcuate portion of said outer liner, and a portion of said dome pate located radially outside said flow passages.

15. The combustor of claim 13, said vortex cavity being formed by a first portion of said inner liner, a second portion of said inner liner, a first arcuate portion of said inner liner, and a portion of said dome plate located radially inside said flow passages.

16. The combustor of claim 13, wherein said liner is made of metal.

17. The combustor of claim 13, wherein said liner is made of Ceramic Matrix Composite material.

18. The combustor of claim 17, wherein said inner and outer liners are connected to said dome plate so as to allow radial expansion of said dome plate.

19. The combustor of claim 13, wherein said predetermined radius of said first arcuate liner portion is in a range of approximately 6–12 times said thickness of said first and second liner portions.

20. A liner for a gas turbine engine combustor having a trapped vortex cavity formed therein, wherein a dome plate is positioned at an upstream end of said combustor, said liner comprising:

(a) a first portion positioned adjacent and connected to said dome plate, wherein said first line portion extends downstream from and substantially perpendicular to said dome plate;

(b) a second portion extending substantially perpendicular to said first liner portion and substantially parallel to said dome plate;

(c) a first arcuate portion located between said first and second liner portions configured to have a predetermined radius which limits stress on said second liner portion to a predetermined level;

(d) a third portion extending downstream and substantially perpendicular to said second liner portion; and, (e) a second arcuate portion located between said second and third liner portions;

wherein said first liner portion, said second liner portion, said first arcuate liner portion and a portion of said dome plate form said trapped vortex cavity.

* * * * *

UNITED STATES PATENT AND TRADEMARK OFFICE

CERTIFICATE OF CORRECTION

PATENT NO. : 6,851,263 B2
DATED : February 8, 2005
INVENTOR(S) : James Anthony Stumpf et al.

It is certified that error appears in the above-identified patent and that said Letters Patent is hereby corrected as shown below:

Column 5,
Line 67, delete “line” and substitute -- liner --.

Column 6,
Line 46, delete “potions” and substitute -- portions --.
Line 57, delete “pate” and substitute -- plate --.
Line 59, insert -- trapped -- after said” and before “vortex”

Column 7,
Line 13, delete “line” and substitute -- liner --.

Signed and Sealed this

Ninth Day of May, 2006

JON W. DUDAS
*Director of the United States Patent and Trademark Office*